US007122158B2

(12) United States Patent
Itoh

(10) Patent No.: US 7,122,158 B2
(45) **Date of Patent: *Oct. 17, 2006**

(54) TEST TUBE HOLDER

(76) Inventor: Teruaki Itoh, 5-25, Kokaihommachi, Kumamoto-shi, Kumamoto-ken (JP)

( * ) Notice: Subject to any disclaimer, the term of this patent is extended or adjusted under 35 U.S.C. 154(b) by 561 days.

This patent is subject to a terminal disclaimer.

(21) Appl. No.: 10/368,408

(22) Filed: Feb. 20, 2003

(65) Prior Publication Data

US 2003/0161764 A1 Aug. 28, 2003

(30) Foreign Application Priority Data

Feb. 28, 2002 (JP) ..... 2002-054203

(51) Int. Cl.
*B01L 9/06* (2006.01)

(52) U.S. Cl. ..... 422/104; 422/99; 422/102

(58) Field of Classification Search ..... None
See application file for complete search history.

(56) References Cited

U.S. PATENT DOCUMENTS 5,985,219 A * 11/1999 Lind ..... 422/104

6,932,942 B1 * 8/2005 Itoh ..... 422/104

* cited by examiner

*Primary Examiner*—Yelena Gakh
*Assistant Examiner*—Paul Hyun
(74) *Attorney, Agent, or Firm*—Nixon & Vanderhye P.C.

(57) ABSTRACT

A test tube holder includes a test tube insertion adapter having an adapter body and an elastic annular band and projections. The adapter body includes a flange section, an annular section, a plurality of flat spring sections whose proximal end portions are connected to the annular section and whose distal end portions extend inward in the cylindrical hollow and bent toward the axis of the adapter body and contact sections which are formed on the inner surfaces of the flat spring sections. The elastic annular band designed to bind the flat spring sections together while surrounding the outer surfaces thereof over a given range in order to bring the contact sections into contact with the outer surfaces of the test tubes. The projections projected from the outer surfaces of the flat spring sections to hold the elastic annular band in a given position.

9 Claims, 4 Drawing Sheets

TEST TUBE HOLDER

CROSS-REFERENCE TO RELATED APPLICATIONS

This application is based upon and claims the benefit of priority from the prior Japanese Patent Application No. 2002-054203, filed Feb. 28, 2002, the entire contents of which are incorporated herein by reference.

BACKGROUND OF THE INVENTION

1. Field of the Invention

The present invention relates to a test tube holder that is capable of holding a test tube, which keeps a specimen such as blood, in an upright position and is suitable for conveying the test tube.

2. Description of the Related Art

Conventionally test tube holders called columnar racks have been used a lot. The columnar racks each have a columnar base body made of synthetic resin. An engagement groove with which a guide rail of a conveyor belt is engaged and a control groove for controlling the conveyance of a test tube by the conveyor belt are formed on the outer surface of a proximal end portion of the columnar base body such that the test tube can easily be conveyed by the conveyor belt. The columnar base body has a cylindrical hollow for holding and keeping the test tube in an upright position at the core of the columnar base body.

In the conventional columnar rack or test tube holder, the cylindrical hollow is so designed that its size matches that of a specific test tube. Therefore, the columnar rack or the test tube holder cannot be applied to a test tube of size (especially the outside diameter) different from that of the specific test tube.

BRIEF SUMMARY OF THE INVENTION

An object of the present invention is to provide a versatile test tube holder that is applicable to a plurality of test tubes having different outside diameters.

In order to attain the above object, the test tube holder according to the present invention has the following characteristic configuration. The other characteristic configurations will be clarified in the First to Fourth Embodiments later.

A test tube holder according to the present invention comprises a holder body including engagement sections which are formed on an outer surface of a proximal end portion of a columnar base body and engaged with conveying guide rails and a cylindrical hollow for holding a test tube at a core of the columnar base body, and a test tube insertion adapter fitted into the cylindrical hollow of the holder body and provided to selectively hold test tubes whose outside diameters differ from each other, wherein the test tube insertion adapter includes:

an adapter body having a flange section which contacts an end face of an opening of the cylindrical hollow, an annular section which ranges with an inner circumference of the flange section and is fitted on an inner surface of the opening, a plurality of flat spring sections whose proximal end portions are arranged at regular intervals along a circumference of the annular section and connected to the annular section and whose distal end portions extend inward in the cylindrical hollow and bent toward an axis of the adapter body such that the adapter body is shaped like a funnel, and contact sections which are formed on inner surfaces of the distal end portions of the flat spring sections, respectively and contact outer surfaces of the test tubes to be held;

an elastic annular band with which the flat spring sections are bound together while surrounding outer surfaces of the flat spring sections in order to bring the contact sections of the adapter body into contact with the outer surfaces of the test tubes at given pressure; and projections projected from outer surfaces of at least some of the flat spring sections to hold the elastic annular band in a given position in a longitudinal direction of the flat spring sections.

In the test tube holder described above, when a test tube having a relatively small outside diameter is inserted in the test tube holder described above, it is held at the contact sections of the flat spring sections of the test tube insertion adapter and the bottom (not shown) of the cylindrical hollow by give holding force. When a test tube having a relatively large outside diameter is inserted therein, it is held at the contact sections and the flat spring sections are bound with the elastic annular band of each of the flat spring sections of the test tube insertion adapter and the bottom (not shown) of the cylindrical hollow by holding force that is greater than the above holding force. In other words, when the test tube having a relatively large outside diameter is inserted, the amount of bend increases at a location where the contact sections of the flat spring sections are present, and the middle portion of the above test tube is strongly bound by the elastic annular band over the range corresponding to the width of the elastic annular band. Thus, the test tubes are held in appropriate holding manner and by appropriate holding force according to the size of the outside diameter of each of the test tubes.

DETAILED DESCRIPTION OF THE INVENTION (First Embodiment)

Figure 1:
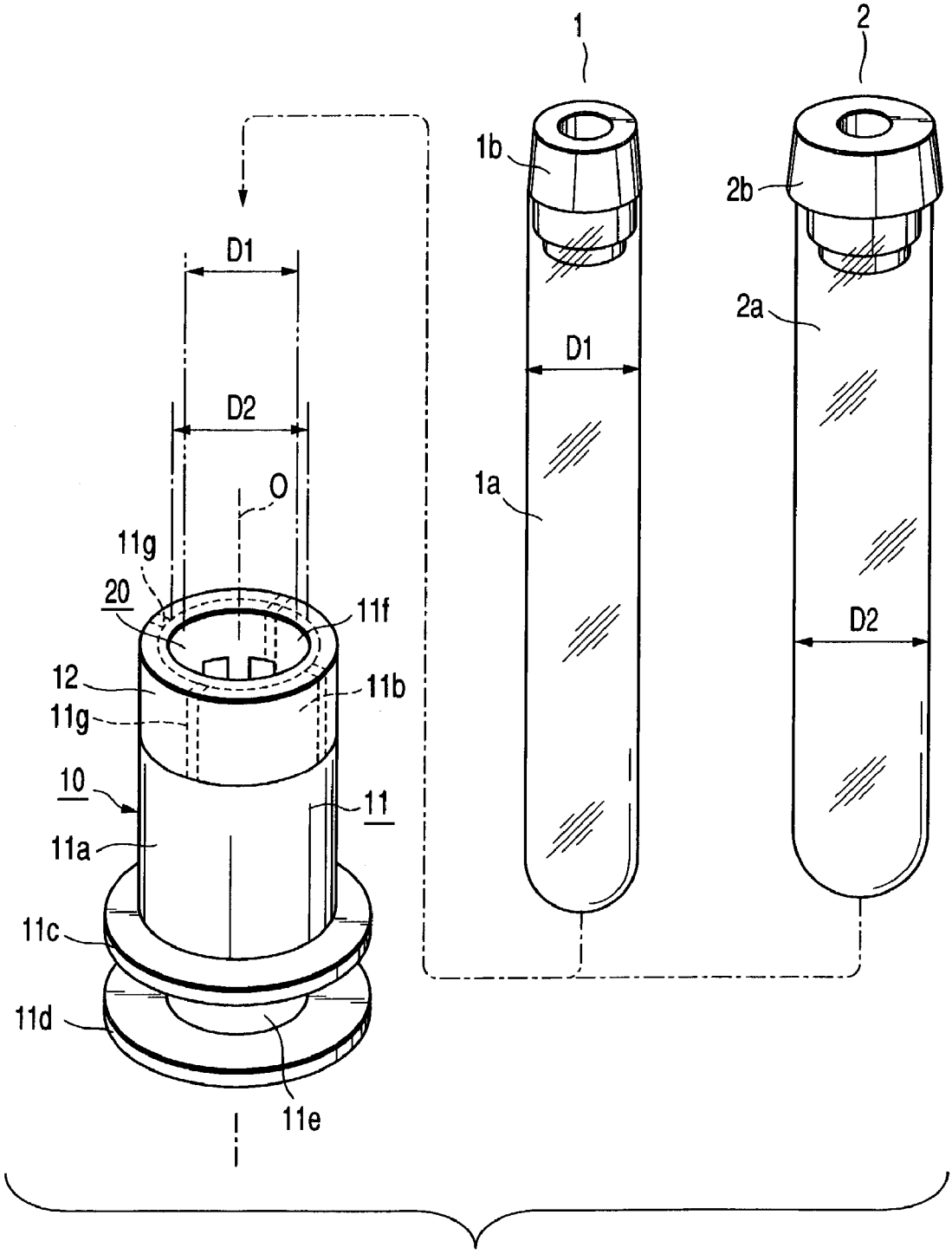
FIG. 1 is a perspective view schematically showing a configuration of a test tube holder according to a first embodiment of the present invention.

FIG. 1 shows a test tube holder according to a first embodiment of the present invention. The test tube holder includes a holder body 10 and a test tube insertion adapter 20 fitted into the holder body 10. Even though any one of a plurality of test tubes having different outside diameters (two test tubes 1 and 2 having different outside diameters D1 and D2 in the first embodiment) is inserted into the test tube holder, the adapter 20 can hold the inserted test tube with stability. The test tubes 1 and 2 include tube bodies 1*a* and 2*a*, respectively, and the openings of the tube bodies 1*a* and 2*a* are closed with caps 1*b* and 2*b*, respectively.

The holder body 10 includes engagement sections (two flange sections 11*c* and 11*d* in the first embodiment), which are to be engaged with conveying guide rails (not shown), on the outer surface of a proximal end portion (a lower end portion in FIG. 1) of a columnar base body 11 that is made of, e.g., synthetic resin. The holder body 10 also includes a cylindrical hollow 11*f* for holding a test tube at the core of the columnar base body 11. The hollow 11*f* has a given depth from the distal end (upper end in FIG. 1) to the proximal end (lower end in FIG. 1), the depth corresponding to a location where the flange section 11*c* is provided.

The two flange sections 11*c* and 11*d* of the engagement sections are provided to prevent the test tube holder from toppling due to vibrations or the like during the conveyance of the test tube holder. The flange sections 11*c* and 11*d* are engaged with guide rails (not shown) arranged on both sides of a belt conveyer (not shown). An annular groove 11*e* is formed between the two flange sections 11*c* and 11*d*. A stopping pin, which is driven by a piston/cylinder device (not shown) for controlling the conveyance of the holder, is inserted in the groove 11*e* to stop the test tube holder in a specific position of the belt conveyor.

The columnar base body 11 has a large-diameter section 11*a* on its middle part in the longitudinal direction and a small-diameter section 11*b* that ranges with the large-diameter section 11*a* and corresponds to the distal end portion of the columnar base body 11. A metallic fastening ring 12, which serves as an indicator for detecting the presence of the holder body 10 by a photodetector or the like, is fitted on the small-diameter section 11*b*. A plurality of slits 11*g* (four slits in the first embodiment) are arranged in parallel on the small-diameter section 11*b* in the longitudinal direction of the base body 11.

Figure 2A:
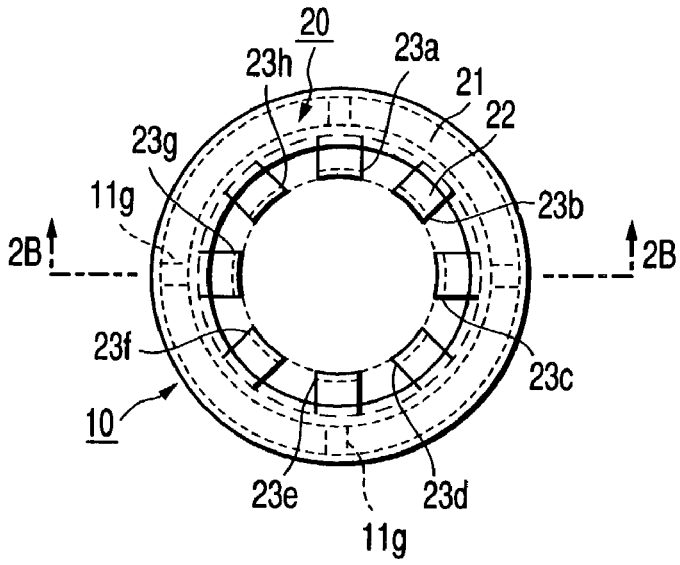
FIG. 2A is a top view specifically showing the configuration of the test tube holder according to the first embodiment of the present invention.
Figure 2B:
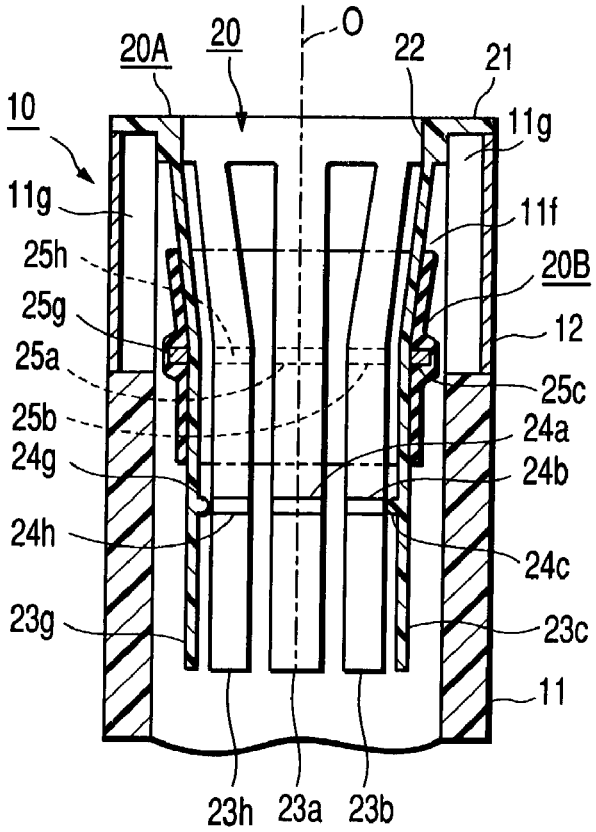
FIG. 2B is a cross-sectional view taken along line 2B—2B of FIG. 2A.

As illustrated in FIGS. 2A and 2B, the test tube insertion adapter 20 includes an adapter body 20A that is molded in one piece using elastic material such as synthetic resin and an elastic annular band 20B that is mounted on the outer surface of the adapter body 20A and molded in one piece using elastic material such as rubber.

The adapter body 20A includes a flange section 21, an annular section 22, a plurality of flat spring sections 23 (23*a* to 23*h*), and contact sections 24 (24*a* to 24*h*). The flange section 21 contacts the end face of the opening of the cylindrical hollow 11*f* of the holder body 10. The annular section 22 ranges with the inner circumference of the flange section 21 and is fitted on the inner surface of the opening. The proximal end portions of the flat spring sections 23 are arranged at regular intervals along the circumference of the annular section 22 and connected to the annular section 22, and the distal end portions thereof extend inward in the cylindrical hollow 11*f* and bend toward the axis O of the adapter body 20A such that the adapter body 20A is shaped like a funnel. The contact sections 24 are formed on the inner surfaces of the distal end portions of the flat spring sections 23, respectively and contact the outer surfaces of the test tubes 1 and 2 to be held.

The elastic annular band 20B is a flat-spring binding member that is shaped like a funnel as a whole. Specifically, the elastic annular band 20B is designed to bind the flat spring sections 23 together while surrounding the outer surfaces thereof over a given range, thereby pressing the contact sections 24 on the outer surfaces of the test tubes 1 and 2 at given pressure.

Figure 3:
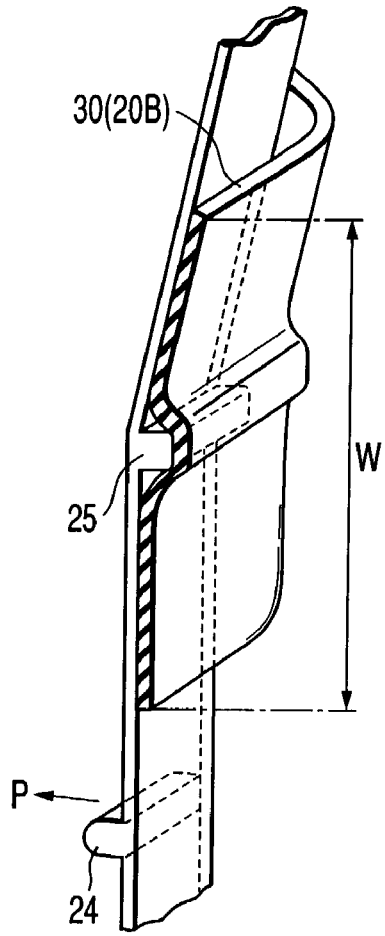
FIG. 3 is a perspective view showing a structure of a main part of each of a flat spring section and an elastic annular band of a test tube insertion adapter of the test tube holder according to the first embodiment of the present invention.

As clearly shown in FIG. 3, the elastic annular band 20B of the first embodiment is formed of a rubber band 30 having a width W. The rubber band 30 is provided to tightly bind the regions of the outer surfaces of the flat spring sections 23, which correspond to the width W. The contact sections 24 therefore bend toward the axial direction of the adapter body 20A as indicated by the arrow P in FIG. 3. As illustrated in FIG. 3, at least some of the flat spring sections 23 (all of the flat spring sections 23 in the first embodiment) have prismatic projections 25 (25*a* to 25*h*) on their outer surfaces. These projections are provided to hold the rubber band 30 in a given position in the longitudinal direction of the flat spring sections 23.

The function of the above test tube holder according to the first embodiment will now be described with reference to FIGS. 4A and 4B.

Figure 4A:
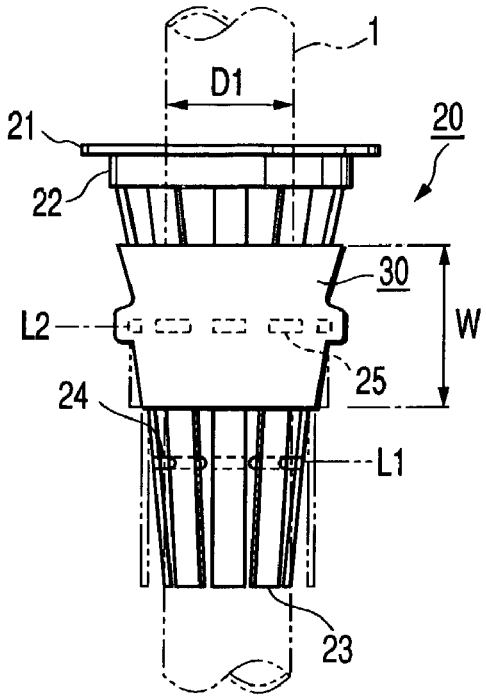
FIG. 4A is a side view of the test tube insertion adapter of the test tube holder according to the first embodiment of the present invention, in which a test tube whose outside diameter is relatively small is inserted.

When the test tube 1 having a relatively small outside diameter D1 is inserted into the test tube holder with the test tube insertion adapter 20 as shown in FIG. 4A, all of the contact sections 24 of the adapter 20 are brought into contact with the outer surface of the test tube 1. Then, the distal end portions of the flat spring sections 23 are slightly expanded. The outer surface of the test tube 1 is thus held in an axial position of the holder 20 at, given pressure by means of the contact sections 24. Consequently, the test tube 1 is supported at two locations of a level L1 at which the contact sections 24 are present and a level L0 (not shown) at which the bottom of the cylindrical hollow 11*f*. Since the test tube 1 having an outside diameter D1 is relatively light, it can be held with high stability in the holding manner and by the holding force as described above.

Figure 4B:
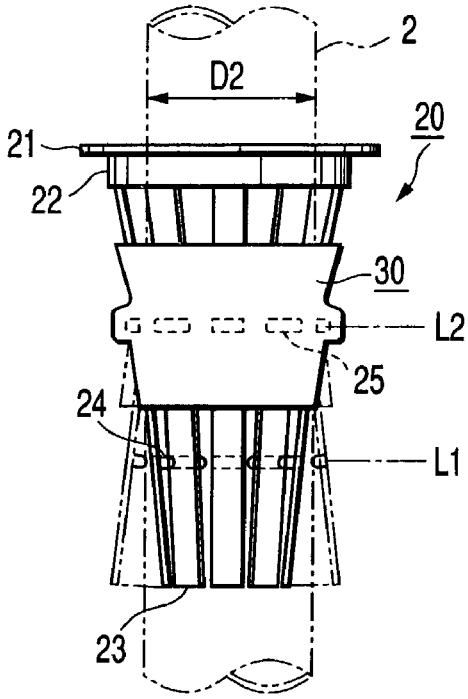
FIG. 4B is a side view of the test tube insertion adapter of the test tube holder according to the first embodiment of the present invention, in which a test tube whose outside diameter is relatively large is inserted.

When the test tube 2 having a relatively large outside diameter D2 is inserted into the test tube holder with the test tube insertion adapter 20 as illustrated in FIG. 4B, all of the contact sections 24 of the adapter 20 are brought into contact with the outer surface of the test tube 2. Then, the distal end portions of the flat spring sections 23 are greatly expanded. The outer surface of the test tube 2 is thus held in an axial position of the holder 20 at the pressure that is greater than the above given pressure shown in FIG. 4A by means of the contact sections 24 that increase in pressure. Further, the inner surfaces of the flat spring sections, on which the rubber band 30 is fitted, are brought into contact with the outer surface of the test tube 2 at a great force. Consequently, the test tube 2 is supported at three locations of a level L1 at which the contact sections 24 are present, a level (average level) 2 at which the rubber band is fitted, and a level L0 (not shown) at which the bottom of the cylindrical hollow 11*f*. The flat spring sections are bound together with the rubber band 30 very tightly over a wide range corresponding to the width W. Though the test tube 2 having an outside diameter D2 is relatively heavy, it can be held with high stability in the holding manner and by the holding force as described above.

(Second Embodiment)

Figure 5A:
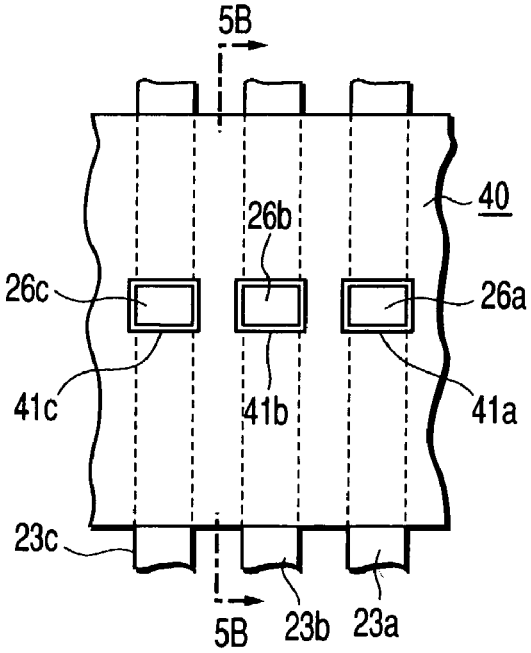
FIG. 5A is a partial side view showing a structure of a main part of a test tube insertion adapter of a test tube holder according to a second embodiment of the present invention.
Figure 5B:
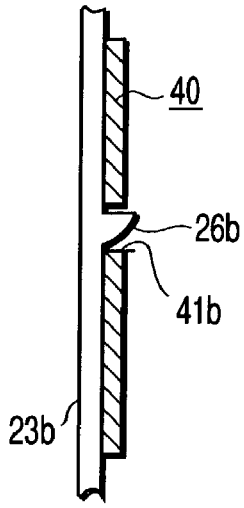
FIG. 5B is a cross-sectional view taken along line 5B—5B of FIG. 5A.

FIG. 5A is a partial side view showing a structure of a main part of a test tube insertion adapter of a test tube holder according to a second embodiment of the present invention. FIG. 5B is a cross-sectional view taken along line 5B—5B of FIG. 5A. The second embodiment differs from the first embodiment in that projections 26 (26*a* to 26*c*) each having a stopping lug are provided on the respective surfaces of flat spring sections 23 (23*a* to 23*c*) fitted into a fitting holes 41 (41*a* to 41*c*) formed in a rubber band 40 for binding the flat spring sections. With this structure, the projections 26 (26*a* to 26*c*) reliably stop the fitting holes 41 (41*a* to 41*c*). Therefore, even though an adapter body 20A is vibrated, the rubber band 40 does not slip down from the flat spring sections 23 (23*a* to 23*c*). Since the second embodiment is the same as the first embodiment except for the above, its detailed descriptions are omitted.

(Third Embodiment)

Figure 6A:
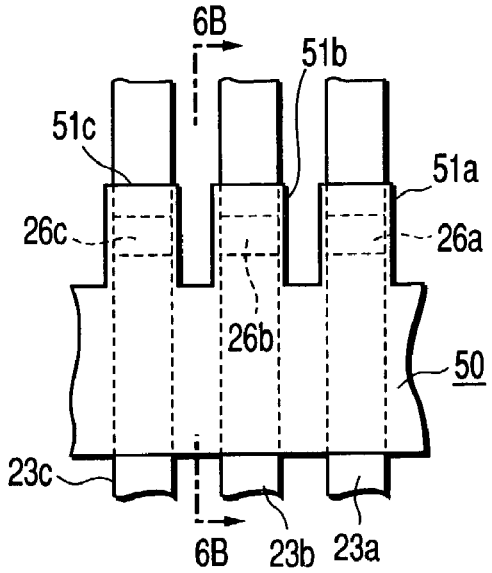
FIG. 6A is a partial side view showing a structure of a main part of a test tube insertion adapter of a test tube holder according to a third embodiment of the present invention.
Figure 6B:
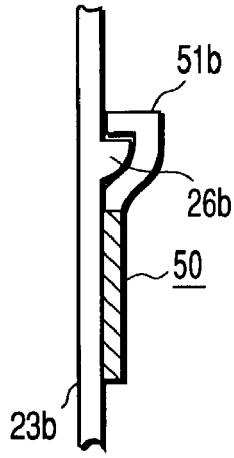
FIG. 6B is a cross-sectional view taken along line 6B—6B of FIG. 6A.

FIG. 6A is a partial side view showing a structure of a main part of a test tube insertion adapter of a test tube holder according to a third embodiment of the present invention. FIG. 6B is a cross-sectional view taken along line 5B—5B of FIG. 5A. The third embodiment differs from the second embodiment in that hooks 51 (51*a* to 51*c*) provided on a rubber band 50 for binding flat spring sections 23 (23*a* to 23*c*) are hooked on projections 26 (26*a* to 26*c*) each having a stopping lug. With this structure, the projections 26 (26*a* to 26*c*) reliably stop the hooks 51 (51*a* to 51*c*). Therefore, even though an adapter body 20A is vibrated, the rubber band 50 does not slip down from the flat spring sections 23 (23*a* to 23*c*). According to the third embodiment, the rubber band 50 can be removed relatively easily when it is replaced with a new one. Since the third embodiment is the same as the second embodiment except for the above, its detailed descriptions are omitted.

(Fourth Embodiment)

Figure 7A:
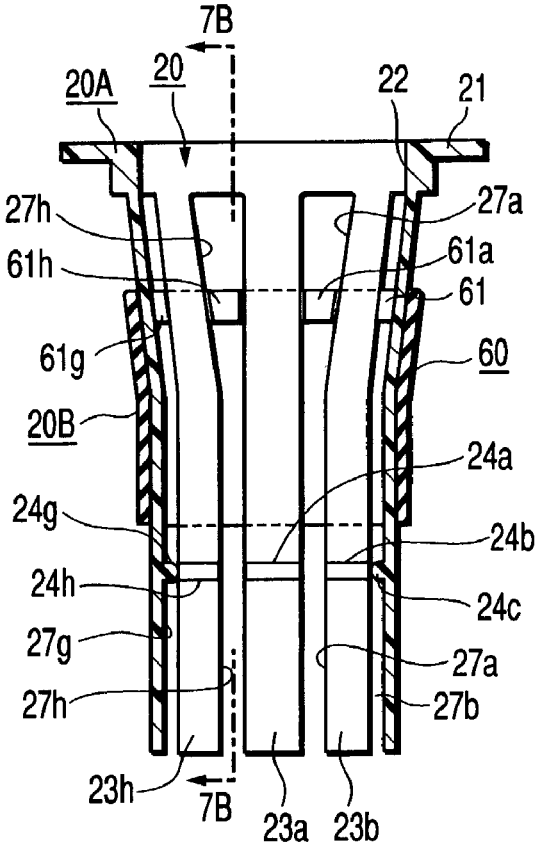
FIG. 7A is a cross-sectional side view showing a structure of a test tube insertion adapter of a test tube holder according to a fourth embodiment of the present invention.
Figure 7B:
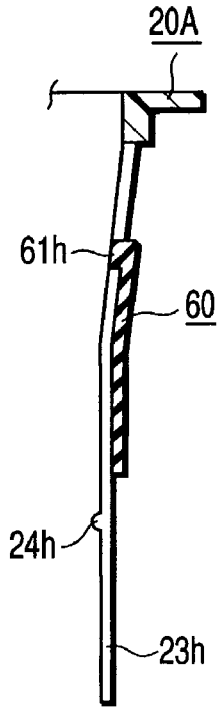
FIG. 7B is a cross-sectional view taken along line 7B—7B of FIG. 7A.

FIG. 7A is a cross-sectional side view showing a structure of a test tube insertion adapter of a test tube holder according to a fourth embodiment of the present invention. FIG. 7B is a cross-sectional view taken along line 7B—7B of FIG. 7A. The fourth embodiment differs from the first embodiment in that a plurality of projections 61 (61*a* to 61*h*) are arranged on the inner surface of a rubber band 60 serving as an elastic annular band 20B along the circumferential direction and inserted into their respective slits 27 (27*a* to 27*h*) each formed between a plurality of flat spring sections 23 (23*a* to 23*h*) to hold a rubber band 60 in a given position in the longitudinal direction of the flat spring sections 23 (23*a* to 23*h*). In the fourth embodiment, the projections 61 (61*a* to 61*h*) are formed on the inner surface of the rubber band 60 and close to the opening located at the flange section of an adapter body 20A such that they are integrally molded into one piece.

The flat spring sections 23 (23*a* to 23*h*) have a uniform width and their end portions extend inward in a cylindrical hollow 11*f* and bend toward the axis O of the adapter body 20A such that the adapter body 20A is shaped like a funnel. The slits 27 (27*a* to 27*c*) gradually decrease in width toward their end portions (lower portions in FIGS. 7A and 7B). If, therefore, the rubber band 60 moves to the distal end portions of the flat spring sections 23 (23*a* to 23*h*), the projections 61 (61*a* to 61*h*) inserted into the slits 27 (27*a* to 27*c*) are each strongly caught by the flat spring sections on both sides of the slit. Therefore, even though the adapter body 20A is vibrated, the rubber band 60 does not slip down from the flat spring sections 23 (23*a* to 23*c*). Since the second embodiment is the same as the first embodiment except for the above, its detailed descriptions are omitted.

(Features of the Embodiments)

[1] A test tube holder according to the embodiments of the present invention, comprises:

a holder body 10 including engagement sections 11*c* and 11*d* which are formed on the outer surface of a proximal end portion of a columnar base body 11 and engaged with conveying guide rails and a cylindrical hollow 11*f* for holding a test tube at the core of the columnar base body 11; and a test tube insertion adapter 20 fitted into the cylindrical hollow 11*f* of the holder body 10 and provided to selectively hold test tubes 1 and 2 whose outside diameters differ from each other, wherein the test tube insertion adapter 20 includes:

an adapter body 20A having a flange section 21 which contacts the end face of an opening of the cylindrical hollow 11*f*, an annular section 22 which ranges with the inner circumference of the flange section 21 and is fitted on the inner surface of the opening, a plurality of flat spring sections 23 (23*a* to 23*h*) whose proximal end portions are arranged at regular intervals along the circumference of the annular section 22 and connected to the annular section 22 and whose distal end portions extend inward in the cylindrical hollow 11*f* and bent toward the axis O of the adapter body such that the adapter body is shaped like a funnel, and contact sections 24 (24*a* to 24*h*) which are formed on the inner surfaces of the distal end portions of the flat spring sections 23 (23*a* to 23*h*), respectively and contact the outer surfaces of the test tubes 1 and 2 to be held;

an elastic annular band 20B with which the flat spring sections 23 (23*a* to 23*h*) are bound together while surrounding the outer surfaces of the flat spring sections 23 (23*a* to 23*h*) in order to bring the contact sections 24 of the adapter body 20A into contact with the outer surfaces of the test tubes 1 and 2 at given pressure; and projections 25 (25*a* to 25*h*) projected from the outer surfaces of at least some of the flat spring sections 23 (23*a* to 23*h*) to hold the elastic annular band 20B in a given position in the longitudinal direction of the flat spring sections 23.

When the test tube 1 having a relatively small outside diameter D1 is inserted in the test tube holder described above, it is held at the contact sections 24 of the flat spring sections 23 of the test tube insertion adapter 20 and the bottom (not shown) of the cylindrical hollow by give holding force. When the test tube 2 having a relatively large outside diameter D2 is inserted in the holder, it is held at the contact sections 24 of the flat spring sections 23 in the test tube insertion adapter 20, the inner surface on which the elastic annular band 20B is fitted, and the bottom (not shown) of the cylindrical hollow by holding force that is greater than the above holding force. In other words, when the test tube 2 is inserted, the amount of bend increases at a location where the contact sections 24 of the flat spring sections 23 are present, and the middle portion of the test tube 2 is strongly bound by the elastic annular band 20B over the range corresponding to the width W of the elastic annular band 20B. Therefore, the test tube 2 is held by the holding force that is greater than that in the case where the test tube 1 is inserted.

Thus, the test tubes are held in appropriate holding manner and by appropriate holding force according to the size of the outside diameter of each of the test tubes. It is thus possible to provide a general-purpose test tube holder that can be applied to a plurality of test tubes having different outside diameters. The test tube holder of the present invention can be applied to any test tubes having an outside diameter that is smaller than the inside diameter of the annular section 22 of the adapter body 20A.

[2] In the test tube holder according to the embodiments, described in the above paragraph [1], the adapter body 20A is molded in one piece using elastic material such as synthetic resin.

Since the test tube holder is easy to manufacture, its manufacturing costs are low.

[3] In the test tube holder according to the embodiments, described in one of the above paragraphs [1] and [2], the elastic annular band 20B is shaped like a funnel as a whole such that an inner surface of the elastic annular band 20B is brought into intimate contact with the outer surfaces of the flat spring sections 23.

In the test tube holder, the elastic annular band 20B shaped like a funnel is fitted on the outer surface of the adapter body 20A shaped like a funnel. The fitting is easy and the flat spring sections 23 of the adapter body 20A are bound with binding force that is uniformed in the longitudinal direction thereof.

[4] In the test tube holder according to the embodiments, described in one of the above paragraphs [1], [2] and [3], the elastic annular band 20B (40) includes fitting holes 41 (41*a* to 41*c*) into which the projections (25, 26) are fitted.

According to the test tube holder described above, the holding force for holding the elastic annular band 20B (40) in a given position of the flat spring sections 23 (23*a* to 23*c*) increases.

[5] In the test tube holder according to the embodiments, described in one of the above paragraphs [1], [2] and [3], the elastic annular band 20B (40) includes hooks 51 (51*a* to 51*c*) that are hooked on the projections (25, 26).

According to the test tube holder, not only the holding force increases as described in the above paragraph [4], but also the elastic annular band 20B (40) can relatively easily be removed from the flat spring sections 23 (23*a* to 23*c*).

[6] A test tube holder according to the embodiments of the present invention, comprises:

a holder body 10 including engagement sections 11*c* and 11*d* which are formed on the outer surface of a proximal end portion of a columnar base body 11 and engaged with conveying guide rails and a cylindrical hollow 11*f* for holding a test tube at the core of the columnar base body 11; and a test tube insertion adapter 20 fitted into the cylindrical hollow 11*f* of the holder body 10 and provided to selectively hold test tubes 1 and 2 whose outside diameters differ from each other, wherein the test tube insertion adapter 20 includes:

an adapter body 20A having a flange section 21 which contacts the end face of an opening of the cylindrical hollow 11*f*, an annular section 22 which ranges with the inner circumference of the flange section 21 and is fitted on the inner surface of the opening, a plurality of flat spring sections 23 (23*a* to 23*h*) which are uniform in width and whose proximal end portions are arranged at regular intervals along the circumference of the annular section 22 and connected to the annular section 22 and whose distal end portions extend inward in the cylindrical hollow 11*f* and bent toward the axis O of the adapter body such that the adapter body is shaped like a funnel, and contact sections 24 (24*a* to 24*h*) which are formed on the inner surfaces of the distal end portions of the flat spring sections 23 (23*a* to 23*h*), respectively and contact the outer surfaces of the test tubes 1 and 2 to be held; and an elastic annular band 20B with which the flat spring sections 23 (23*a* to 23*h*) are bound together while surrounding the outer surfaces of the flat spring sections 23 (23*a* to 23*h*) in order to bring the contact sections 24 of the adapter body 20A into contact with the outer surfaces of the test tubes 1 and 2 at given pressure, the elastic annular band 20B including a plurality of projections 61 (61*a* to 61*h*) formed on the inner surface of the elastic annular band 20B along the circumferential direction and inserted into at least some of slits 27 (27*a* to 27*h*) each formed between the flat spring sections 23 (23*a* to 23*h*).

The above test tube holder produces the following advantage. In order to hold the elastic annular band 20B in a given position in the longitudinal direction of the flat spring sections 23 (23*a* to 23*h*), the elastic annular band 20B has only to be provided with the projections 61 (61*a* to 61*h*) by, e.g., an integral molding means. Thus, the manufacture of the test tube holder is considerably easier than that of the test tube holder including projections 25 (25*a* to 25*h*) that are formed on the outer surfaces of the flat spring sections 23 (23*a* to 23*h*) by, e.g., a welding means.

[7] In the test tube holder according to the embodiments, described in the above paragraph [6], the projections 61 (61*a* to 61*h*) are formed on the inner surface of the elastic annular band 20B and close to the opening located at the flange section of the adapter body 20A.

According to the above test tube holder, the projections 61 (61*a* to 61*h*) can easily be inserted into the slits 27*a* to 27*h* since the width of each of the slits is relatively great. Since, moreover, the projections 61 (61*a* to 61*h*) are used when they are located above, the elastic annular band 20B is stably stopped.

MODIFICATIONS

The test tube holder according to the embodiments can be modified as follows:

The elastic annular band 20B can be provided with notches and varied in thickness in the width direction to control the binding force in the width direction.

The adapter body 20A of the test tube insertion adapter 20 can be formed of elastic metal material such as phosphor bronze instead of synthetic resin.

What is claimed is:

1. A test tube holder comprising:

a holder body including engagement sections which are formed on an outer surface of a proximal end portion of a columnar base body and engaged with conveying guide rails and a cylindrical hollow for holding a test tube at a core of the columnar base body; and a test tube insertion adapter fitted into the cylindrical hollow of the holder body and provided to selectively hold test tubes whose outside diameters differ from each other, wherein the test tube insertion adapter includes:

an adapter body having a flange section which contacts an end face of an opening of the cylindrical hollow, an annular section which ranges with an inner circumference of the flange section and is fitted on an inner surface of the opening, a plurality of flat spring sections whose proximal end portions are arranged at regular intervals along a circumference of the annular section and connected to the annular section and whose distal end portions extend inward in the cylindrical hollow and bent toward an axis of the adapter body such that the adapter body is shaped like a funnel, and contact sections which are formed on inner surfaces of the distal end portions of the flat spring sections, respectively and contact outer surfaces of the test tubes to be held;

an elastic annular band with which the flat spring sections are bound together while surrounding outer surfaces of the flat spring sections in order to bring the contact sections of the adapter body into contact with the outer surfaces of the test tubes at given pressure, wherein the elastic annular band is shaped like a funnel as a whole such that an inner surface of the elastic annular band is brought into intimate contact with the outer surfaces of the flat spring sections; and projections projected from outer surfaces of at least some of the flat spring sections to hold the elastic annular band in a given position in a longitudinal direction of the flat spring sections.

2. The test tube holder according to claim 1, wherein the elastic annular band includes hooks that are hooked on the projections.

3. The test tube holder according to claim 1, wherein the adapter body is molded in one piece using elastic material such as synthetic resin.

4. The test tube holder according to claim 3, wherein the elastic annular band includes fitting holes into which the projections are fitted.

5. The test tube holder according to claim 3, wherein the elastic annular band includes hooks that are hooked on the projections.

6. A test tube holder comprising:

a holder body including engagement sections which are formed on an outer surface of a proximal end portion of a columnar base body and engaged with conveying guide rails and a cylindrical hollow for holding a test tube at a core of the columnar base body; and a test tube insertion adapter fitted into the cylindrical hollow of the holder body and provided to selectively hold test tubes whose outside diameters differ from each other, wherein the test tube insertion adapter includes:

an adapter body having a flange section which contacts an end face of an opening of the cylindrical hollow, an annular section which ranges with an inner circumference of the flange section and is fitted on an inner surface of the opening, a plurality of flat spring sections whose proximal end portions are arranged at regular intervals along a circumference of the annular section and connected to the annular section and whose distal end portions extend inward in the cylindrical hollow and bent toward an axis of the adapter body such that the adapter body is shaped like a funnel, and contact sections which are formed on inner surfaces of the distal end portions of the flat spring sections, respectively and contact outer surfaces of the test tubes to be held;

an elastic annular band with which the flat spring sections are bound together while surrounding outer surfaces of the flat spring sections in order to bring the contact sections of the adapter body into contact with the outer surfaces of the test tubes at given pressure; and projections projected from outer surfaces of at least some of the flat spring sections to hold the elastic annular band in a given position in a longitudinal direction of the flat spring sections, wherein the elastic annular band includes fitting holes into which the projections are fitted.

7. A test tube holder comprising:

a holder body including engagement sections which are formed on an outer surface of a proximal end portion of a columnar base body and engaged with conveying guide rails and a cylindrical hollow for holding a test tube at a core of the columnar base body; and a test tube insertion adapter fitted into the cylindrical hollow of the holder body and provided to selectively hold test tubes whose outside diameters differ from each other, wherein the test tube insertion adapter includes:

an adapter body having a flange section which contacts an end face of an opening of the cylindrical hollow, an annular section which ranges with an inner circumference of the flange section and is fitted on an inner surface of the opening, a plurality of flat spring sections whose proximal end portions are arranged at regular intervals along a circumference of the annular section and connected to the annular section and whose distal end portions extend inward in the cylindrical hollow and bent toward an axis of the adapter body such that the adapter body is shaped like a funnel, and contact sections which are formed on inner surfaces of the distal end portions of the flat spring sections, respectively and contact outer surfaces of the test tubes to be held;

an elastic annular band with which the flat spring sections are bound together while surrounding outer surfaces of the flat spring sections in order to bring the contact sections of the adapter body into contact with the outer surfaces of the test tubes at given pressure; and projections projected from outer surfaces of at least some of the flat spring sections to hold the elastic annular band in a given position in a longitudinal direction of the flat spring sections, wherein the elastic annular band includes hooks that are hooked on the projections.

8. A test tube holder comprising:

a holder body including engagement sections which are formed on an outer surface of a proximal end portion of a columnar base body and engaged with conveying guide rails and a cylindrical hollow for holding a test tube at a core of the columnar base body; and a test tube insertion adapter fitted into the cylindrical hollow of the holder body and provided to selectively hold test tubes whose outside diameters differ from each other, wherein the test tube insertion adapter includes:

an adapter body having a flange section which contacts an end face of an opening of the cylindrical hollow, an annular section which ranges with an inner circumference of the flange section and is fitted on an inner surface of the opening, a plurality of flat spring sections which are uniform in width and whose proximal end portions are arranged at regular intervals along a circumference of the annular section and connected to the annular section and whose distal end portions extend inward in the cylindrical hollow and bent toward an axis of the adapter body such that the adapter body is shaped like a funnel, and contact sections which are formed on inner surfaces of the distal end portions of the flat spring sections, respectively and contact outer surfaces of the test tubes to be held;

an elastic annular band with which the flat spring sections are bound together while surrounding outer surfaces of the flat spring sections in order to bring the contact sections of the adapter body into contact with the outer surfaces of the test tubes at given pressure, the elastic annular band including a plurality of projections formed on an inner surface of the elastic annular band along a circumferential direction and inserted into at least some of slits each formed between the flat spring sections.

9. The test tube holder according to claim 8, wherein the projections are formed on the inner surface of the elastic annular band and close to the opening located at the flange section of the adapter body.

* * * * *